US007200886B2

(12) United States Patent
Nuetzel et al.

(10) Patent No.: US 7,200,886 B2
(45) Date of Patent: Apr. 10, 2007

(54) CONSTRUCTION OF A CORROSION-RESISTANT TENSION MEMBER IN THE AREA WHERE IT ENTERS A STRUCTURE, PARTICULARLY AN INCLINED CABLE ON THE PYLON OF A CABLE STAYED BRIDGE

(75) Inventors: Oswald Nuetzel, Munich (DE); Egbert Zimmermann, Haar (DE)

(73) Assignee: Dywidag-Systems International GmbH, Aschheim (DE)

( * ) Notice: Subject to any disclaimer, the term of this patent is extended or adjusted under 35 U.S.C. 154(b) by 0 days.

(21) Appl. No.: 11/141,037

(22) Filed: Jun. 1, 2005

(65) Prior Publication Data

US 2005/0262649 A1 Dec. 1, 2005

(30) Foreign Application Priority Data

Jun. 1, 2004 (DE) ..... 20 2004 008 621 U

(51) Int. Cl.
*E01D 11/04* (2006.01)
*E04C 5/12* (2006.01)

(52) U.S. Cl. ..... 14/22; 14/18; 14/23; 52/223.1

(58) Field of Classification Search ..... 14/18, 14/21–23; 52/223.13, 223.1
See application file for complete search history.

(56) References Cited

U.S. PATENT DOCUMENTS 4,633,540 A * 1/1987 Jungwirth et al. ..... 14/22
4,648,146 A * 3/1987 Nutzel et al. ..... 14/21
4,718,209 A * 1/1988 Hansen et al. ..... 52/223.13
4,848,052 A * 7/1989 Nutzel ..... 52/223.13
5,173,982 A * 12/1992 Lovett et al. ..... 14/22
5,924,250 A * 7/1999 Jungwirth et al. ..... 52/223.9
6,055,691 A * 5/2000 Nutzel et al. ..... 14/22
6,578,328 B2 * 6/2003 Bournand et al. ..... 52/223.13

FOREIGN PATENT DOCUMENTS

DE 88 10 423.0 U1 12/1988
FR 2 642 449 3/1990
JP 08170306 7/1996
JP 2005-344502 A * 12/2005

* cited by examiner

*Primary Examiner*—Raymond Addie
(74) *Attorney, Agent, or Firm*—McGrath, Geissler, Olds & Richardson, PLLC

(57) ABSTRACT

A corrosion-resistant tension member, particularly an inclined cable of a cable stayed bridge, is comprised of a bundle of individual elements, for example, steel wire strands, which in its open area is encapsulated by sheathing, and which within the structure extends inside a guide canal that is formed by a recess pipe. The sheathing—sealing off the front side of the guide canal—is thereby directly or indirectly connected to the structure. Between the sheathing and the entrance point of the tension member into the structure, a connecting pipe is arranged, which on the one hand is detachably connected to the sheathing and on the other hand is connected to the structure by a flange plate.

12 Claims, 4 Drawing Sheets

CONSTRUCTION OF A CORROSION-RESISTANT TENSION MEMBER IN THE AREA WHERE IT ENTERS A STRUCTURE, PARTICULARLY AN INCLINED CABLE ON THE PYLON OF A CABLE STAYED BRIDGE

This nonprovisional application claims priority under 35 U.S.C. § 119(a) on Patent Application No. DE 20 2004 008 621.2 filed in Germany on Jun. 1, 2004, which is herein incorporated by reference.

BACKGROUND OF THE INVENTION

1. Field of the Invention

The invention is directed to the construction of a corrosion-resistant tension member in an area where it enters a structure, particularly an inclined cable at a pylon of a cable-stayed bridge.

2. Description of the Background Art

It is known with cable stayed bridges to load-transmittingly connect inclined cables with a pylon, with the inclined cables extending at an angle to one another and with which the roadway pillar is stayed against the pylon and which are primarily comprised of a bundle of individual elements, for example, steel wire strands. This for one can be accomplished with the stays coming from different directions all converging to the pylon there to be anchored, at times in a crisscross fashion; this requires a plurality of anchoring devices. Another option is to run the stays over the pylon in a saddle-like fashion, whereby the load-bearing forces extending at a right angle to the stay cable axis are transferred via the saddle to the pylon.

If such an inclined cable is damaged, for example, by the presence of corrosion on the steel tension members, it must be possible to replace such an inclined cable. In a conventional solution, a saddle-shaped canal is formed in the pylon for this purpose, into each of which one inclined cable can be inserted (DE 88 10 423 U). The lower area of the canal is comprised of a half tube forming a support trough with a saddle bearing at the vertex, where a saddle pipe sheathing the bundle of individual tension members in this area can be locked into place to avoid longitudinal offset. This is done with a bearing sleeve that is arranged in the vertex of the reversing point along the support trough, which is fitted with a bearing ring that is attached to the saddle pipe.

For stabilization purposes and to bond the individual tension members of the bundle with the saddle pipe, the remaining interstices are filled with a hardening material, for example, cement mortar. To improve the adhesion to the hardening material, the tension members, that is, for example, the steel wire strands, can preferably be roughened by sandblasting, at least in the area of the vertex.

In the conventional solution, the saddle pipe is directly connected with the sheathing of the bundle in the open area of the inclined cable outside the pylon by flange rings. As a result, the canal formed in the pylon, which must have a relatively large diameter, at least a greater height than the diameter of the bundle to make it possible to replace the bundle with the saddle pipe, is open on the front entry and/or exit point of the inclined cable. This opening is a disadvantage, because it is exposed to environmental influences and accessible to animals, particularly birds, which can cause dirt buildups and corrosion.

SUMMARY OF THE INVENTION

It is therefore an object of the present invention to provide a simple and economical method, which also foremost takes statical requirements into consideration, to close the openings in the guide canal for the inclined cable of a cable stayed bridge without compromising the conditions for the exchangeability of the inclined cable.

Essentially, the invention is based on the idea that with a tension member of the previously described kind, particularly with stay cable of a cable stayed bridge, the transition from the sheathing in the open area of the tension member to its connection to the structure, in the case of a cable stayed bridge to the pylon, is accomplished via a connecting pipe, which on the one hand can be tightly connected to the structure, for example, via a flange plate, and on the other hand can be connected to the sheathing in the open area such that a future replacement of the inclined cable is not impeded. By adding an elastic intermediate layer in the area of this connection, a tolerance adjustment can be achieved, and angle movements due to traffic loads, wind action, or the like and, to a certain degree, temperature-induced movements can be absorbed so that bending moments need not be considered in the construction. The result is a simple and economical solution for the connection of the sheathing of an inclined cable to the structure with advantages with regard to construction and installation and to a potentially required replacement of the inclined cable.

It is irrelevant for the application of the invention whether the tension member, particularly the inclined cable, is in the process of being inserted and anchored in the pylon, or whether it is rerouted thereupon via a stay saddle.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION OF THE PREFERRED EMBODIMENTS

Figure 1:
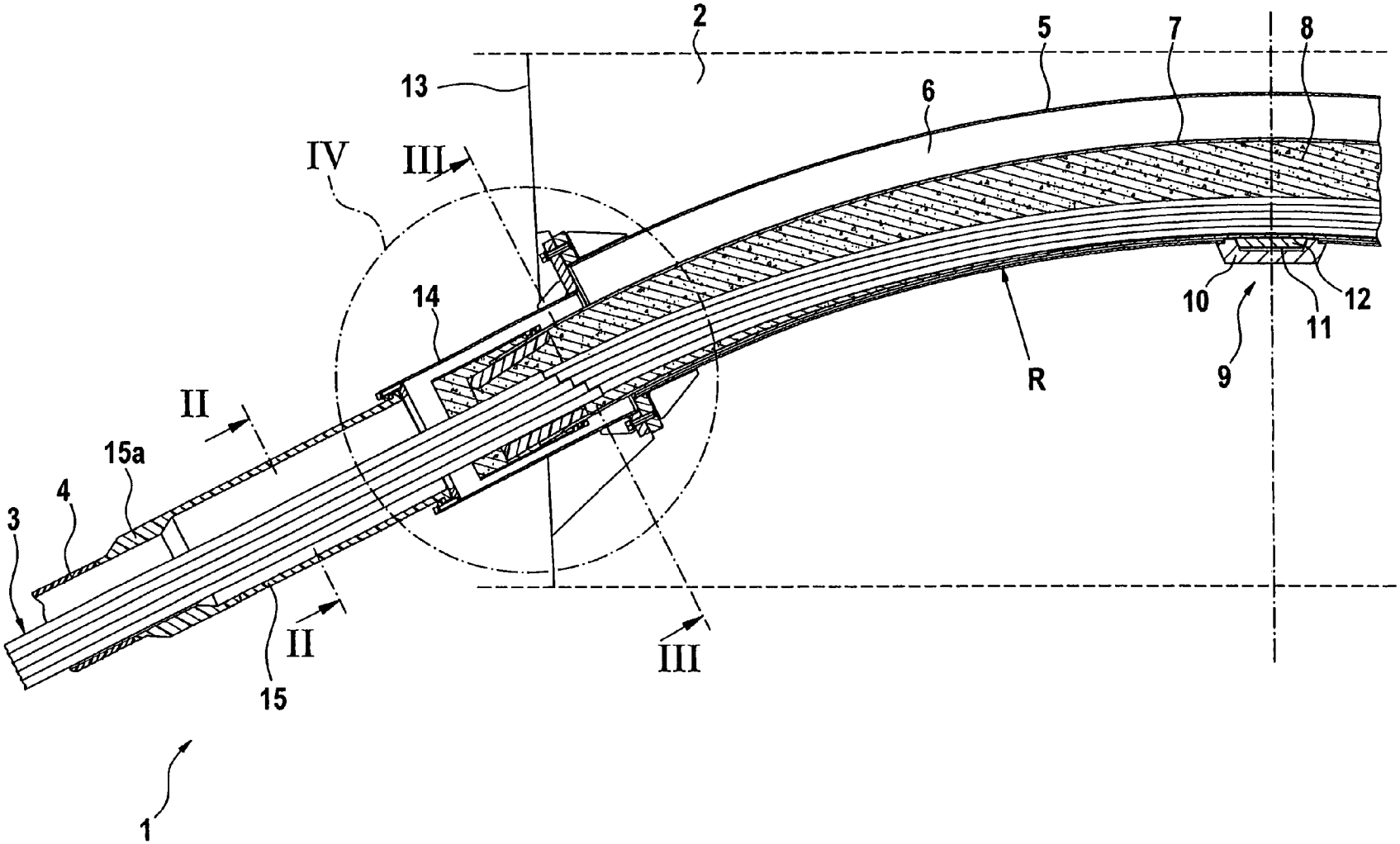
FIG. 1 is a vertical cross section of a connecting point of a sheathing of a tension member according to the present invention, illustrating an inclined cable, which is rerouted on a pylon via a cable saddle, in the area of its entrance into the construction.

FIG. 1 illustrates an embodiment of the invention in a vertical cross section, showing an inclined cable 1 that is rerouted on a pylon 2 made of steel-reinforced concrete. The inclined cable 1 is comprised of a bundle 3 of individual tension members like steel wires, steel rods, or steel strands, which in their open areas are arranged inside a sheathing 4, for example, a pipe sheath made of PE (polyethylene).

In the pylon 2, a saddle-shaped canal 6 having an oval cross section, an open front side, and a radius R, into which the inclined cable 1 can be inserted from the outside in, is formed by a recess pipe 5. In the area of its passage through the pylon 2, the bundle 3 itself, is also guided in a steel saddle pipe 7 in the shape of a circular arc, inside of which the individual tension members of the bundle 3 are bonded with the saddle pipe 7 by grouting mortar 8.

In the vertex area 9 of the rerouting point, a recessed saddle bearing 10 with a recess 11 is located, with which a cleat 12 that is firmly attached to the saddle pipe 7 by welding, for example, engages. This type of anchoring, while allowing complete exchangeability of the stay cable 1, reliably ensures the prevention of longitudinal movements during the installation of the inclined cable and at the same time allows the absorption of differential forces that occur in the longitudinal direction of the inclined cable 1. During the replacement process, this construction allows for the entire inclined cable 1 to be lifted with the saddle pipe 7 until the cleat 12 disengages from the recess 11; the oval shape of the recess pipe 5 (FIG. 3) leaves enough upper space to do this. Thereafter, the inclined cable 1 with the saddle pipe 7 along the circular bend of the rerouting area per radius R can be pulled from the canal 6. A new stay cable can be installed by reversing the steps.

The construction of the connection of the sheathing 4 of the inclined cable 1 to the structure, namely to the pylon 2, according to the present invention, in a way that the canal 6, which is formed by the recess pipe 5, is closed on the front side, is illustrated in FIGS. 2 to 5.

Figure 2:
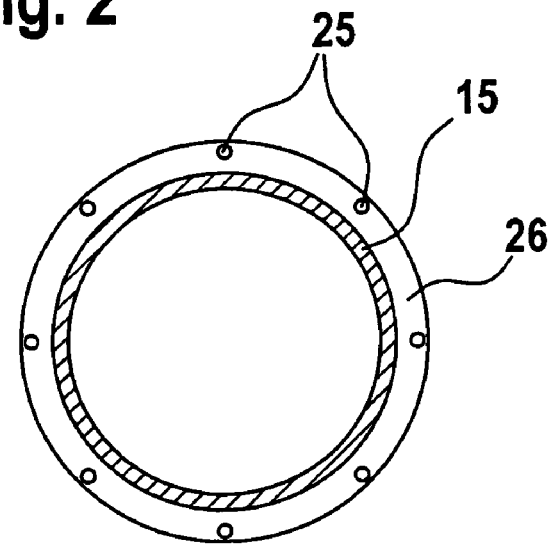
FIG. 2 is a cross section of the sheathing along the line II—II in FIG. 1.

As is shown in FIG. 1, a connecting pipe 14, which is made of steel, is located between the sheathing 4 of the inclined cable 1 in the open area and the outer wall 13 of the pylon 2, which is detachably connected to the sheathing 4 on the one hand and with the pylon 2 on the other hand. In order to overcome potential diameter differences more easily, a transition pipe 15 can be arranged between the sheathing 4 in the normal area and the connecting pipe 14, which, like the sheathing 4, is most often made of plastic, particularly of PE. FIG. 2 shows a cross section along the line II—II of the transition pipe 15. The diameter difference between the sheathing 4 in the open area of the inclined cable 1 and the transition pipe 15 can be compensated for by a transition piece 15*a*.

Figure 4:
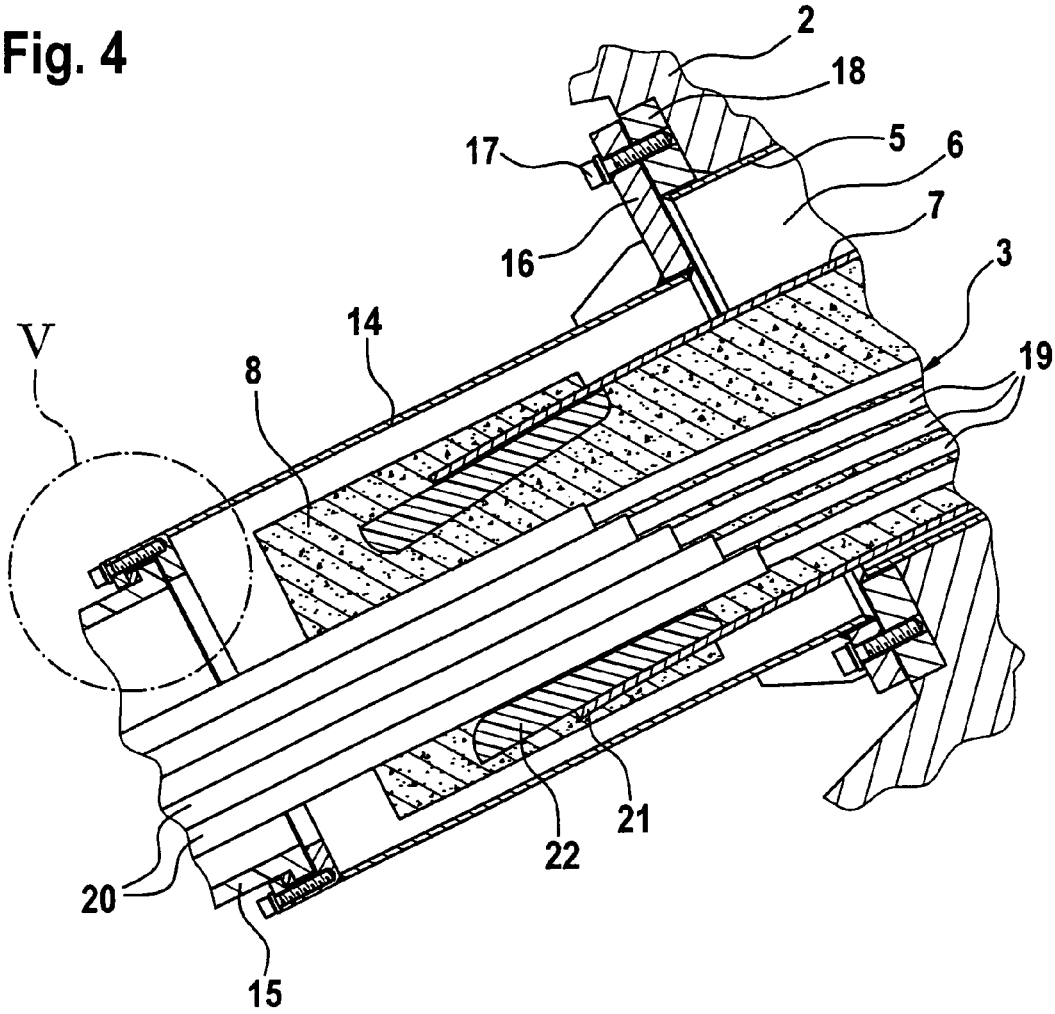
FIG. 4 is the detail IV in FIG. 1 at a larger scale.

As can be particularly seen in FIG. 4, which shows an enlarged illustration of the detail IV of FIG. 1, the connecting pipe 14 has a flange plate 16 on the end facing the structure.

Figure 3:
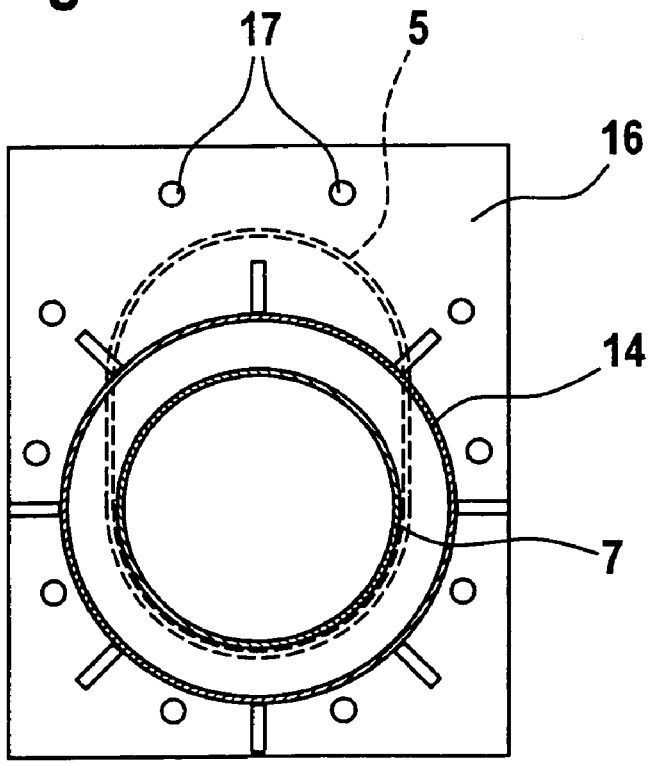
FIG. 3 is a cross section of the sheathing along the line III—III in FIG. 1.

This flange plate 16 can have a rectangular shape since the oval opening of the recess pipe 5 has to be covered (FIG. 3). The flange plate 16 is detachably connectable to the structure 2 by a screw connection 17, for example, opposite a concrete-cast anchor plate 18. The anchor plate 18 conforms to the flange plate 16, at least in its peripheral shape. The flange plate 16 also takes into account the transition from the oval diameter of the recess pipe 5 to the circular diameter of the inclined cable 1, illustrated by the cross section of the connecting pipe 14 and that of the saddle pipe 7. An illustration of the bundle 3 comprised of the individual tension members was omitted in FIGS. 2 and 3 for reasons of clarity.

FIG. 4 also shows the construction of the inclined cable 1 in the area of its exit from the pylon 2. It can be seen how the individual elements of the bundle 3, which in the area of the saddle pipe 7 are bare, that is, not sheathed, but are individually sheathed for corrosion protection in the open area of the inclined cable 1, for example, strands 19 with PE sheathings 20, make the tangential transition from the circular direction inside the saddle pipe 7 to the straight direction in the open area of the inclined cable 1. This transition can be roughly localized at the exit of the inclined cable 1 from the pylon 2 in the area of line III—III in FIG. 1. It is beneficial to extend the length of the circular saddle pipe 7 along the radius R beyond this point to ensure that the end 21 of the saddle pipe 7 is sufficiently spaced apart from the bundle 3 in a radial direction, particularly in its lower area.

In order to achieve a constant soft redirecting of the bundle 3 in this area, particularly with lateral angle deviations, which can be easily determined on site, a cushioning element 22 that is made of an elastic and/or ductile material can be arranged at the at the inner wall of the end 21 of the saddle pipe 7. In its most simple form, this cushioning element 22 can be a piece of pipe; however, it can also be a molded part having an inner contour with rounded edges that is adapted to the behavior of the bundle 3, as illustrated in FIG. 4. It is beneficial to extend this cushioning element 22 beyond the end 21 of the saddle pipe 7 to always ensure a soft support for the bundle 3 there.

In order to be able to fill the complete area of the saddle pipe 7 with grouting mortar 8, a formwork pipe (not shown) can be temporarily put over the end 21 of the saddle pipe 7, which is sealed off against the saddle pipe 7 by a seal. After the front opening of the formwork pipe is sealed off, the entire cavity can be grouted. The formwork pipe with the lid to seal the front opening could be removed again after the grouting mortar 8 had hardened.

Figure 5:
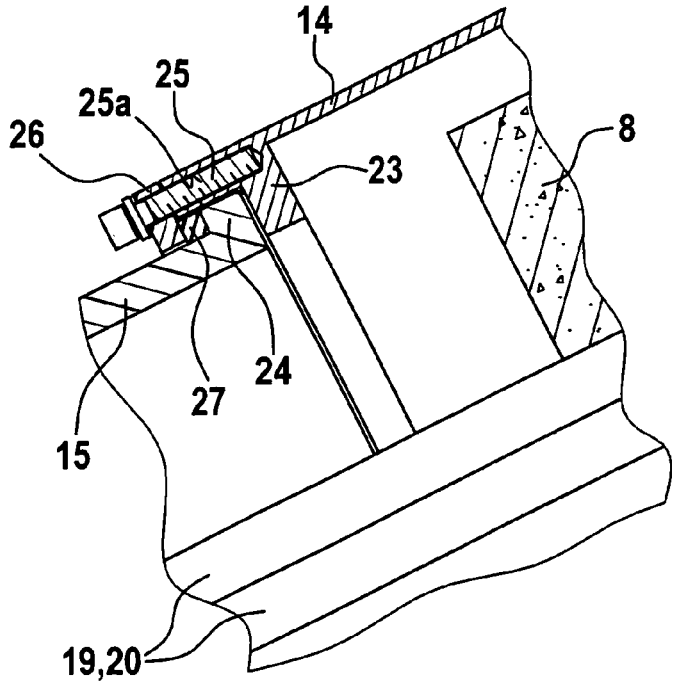
FIG. 5 is the detail V in FIG. 4 at a larger scale.

The detachable connection between the connecting pipe 14 and the sheathing 4, in this embodiment the transition pipe 15, is illustrated in FIG. 5 as detail V of FIG. 4 at a larger scale. On its sheathing end, the connecting pipe 14 has an inner flange 23, to which an outer flange 24 of the transition pipe 15 abuts from the outside. The outer flange 24 can be welded to the end of the PE transition pipe 15. The friction-locked connection between the transition pipe 15 and the connecting pipe 14 is ensured by an axis-parallel screw connection 25, which acts against a loose flange ring 26. The installation of the sheathing is considerably simplified by the flange ring 26, which can be attached from the outside. The force of the screw connection bears on the welded-on PE flange 24 via a ring 27 that is made of an elastic material, for example, rubber or plastic; in this way, constraint tensions due potentially occurring angle errors or movements are avoided and the registration of bending moments is minimized. Furthermore, a softer transmission of stress on the screw connection 25 due to pipe oscillations is thereby achieved.

Figure 6:
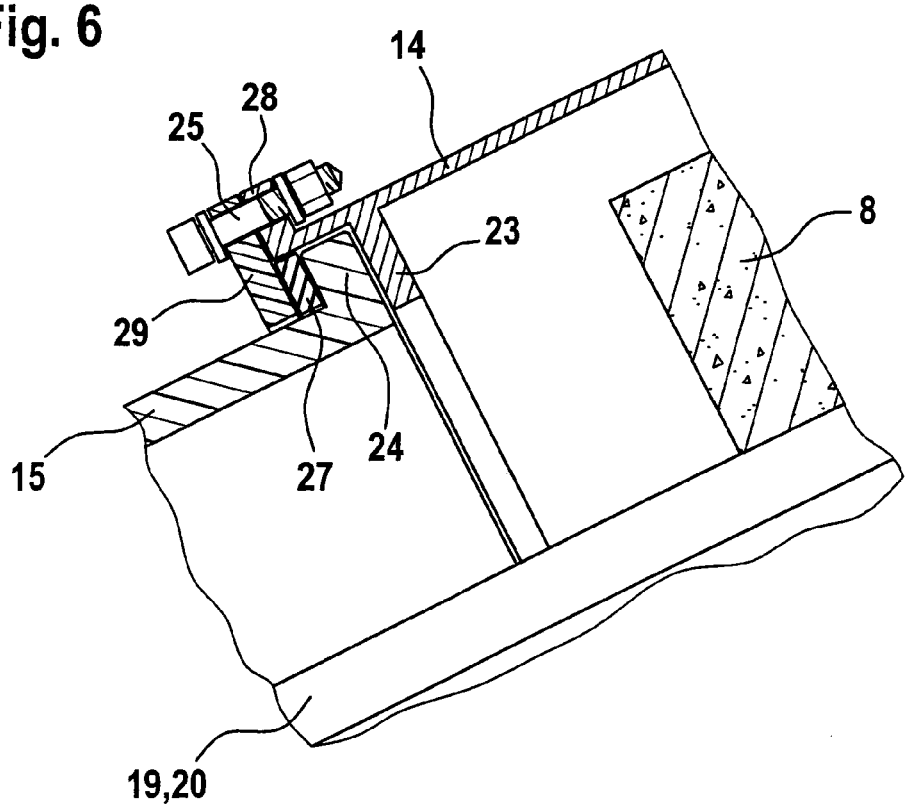
FIGS. 6 and 7 illustrate further embodiments of the connection according to FIG. 5.
Figure 7:
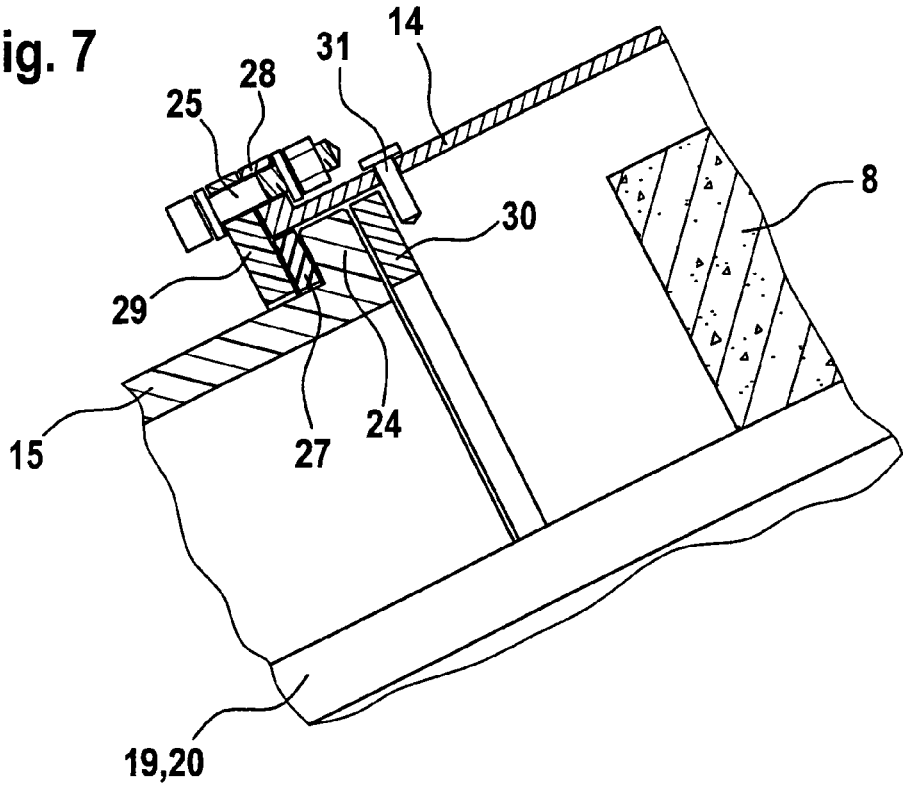

Whereas in the illustrated embodiment in FIG. 5 the axial screw connection 25 is performed via axial bores 25*a* in the outer wall of the connecting pipe 14, which is thicker in this area, a different embodiment is illustrated in FIG. 6. In FIG. 6, the connecting pipe 14 has, apart from the inner flange 23, an outer flange 28 at its end, which is provided with bores for threading the screws for the screw connection 25. This embodiment also has a ring 27 made of an elastic material to compensate for possible angle errors and movements, the ring being arranged between the loose flange ring 29 abutting from the outside and the end flange 24 of the transition pipe 15.

The inner flange 23, which is illustrated in FIGS. 5 and 6 as a one-piece unit with the steel connecting pipe 14, can also be developed as a separate unit, for example, a steel ring 30 with bolts 31, which can be loosened from the outside, for an abutment. In certain instances, this steel ring 30 can also be entirely omitted because the transition pipe 15, which is connected to the sheathing 4, is already pulled against the screw connection 25 by its own weight. As a result, segments of the connecting pipe 14 can be easily opened from the outside for inspection.

It is obvious that the above-described embodiment of the sheathing connection of an inclined cable to the structure can be applied not only when the stay cable is rerouted in the structure, namely the pylon, as is illustrated, but as a matter of course also when the inclined cable is guided straight into the structure to be anchored there in a conventional way. When the inclined cable is guided straight into the structure, in other words, when it is in a concentric position in the recess pipe, the flange plate 16 abutting to the structure can also be a flange ring.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A construction of a corrosion-resistant tension member in an area where the tension member enters a structure, the tension member comprising a bundle of individual elements, open areas of the individual elements being encapsulated by sheathing, the structure having a guide canal arranged therein that is formed by a recess pipe, wherein the sheathing seals off a front opening of the guide canal and is directly or indirectly connected to the structure, a connecting pipe is arranged between the sheathing and an entry point of the tension member into the structure, the connecting pipe is connected to the sheathing and to the structure, and the connection of the connecting pipe with the sheathing and/or structure is detachable, and wherein the connecting pipe directly connects the sheathing to the structure.

2. The construction according to claim 1, wherein, at an end facing the structure, the connecting pipe is connected with a flange plate that covers the front opening of the guide canal, the flange plate being mountable to the structure and has an opening at least for feeding the bundle of individual elements there through.

3. A construction of a corrosion-resistant tension member in an area where the tension member enters a structure, the tension member comprising a bundle of individual elements, open areas of the individual elements being encapsulated by sheathing, the structure having a guide canal arranged therein that is formed by a recess pipe, wherein the sheathing seals off a front opening of the guide canal and is directly or indirectly connected to the structure, wherein a connecting pipe is arranged between the sheathing and an entry point of the tension member into the structure, wherein the connecting pipe is connected to the sheathing and to the structure, and wherein an inner flange is arranged at an end of the connecting pipe that connects with the sheathing, against which an outer flange at an end of the sheathing can be friction-locked fixed into place by a detachable flange ring.

4. The construction according to claim 3, wherein the inner flange on the sheathing-side end of the connecting pipe is a loose flange ring, which can be fixed into place against the connecting pipe to avoid position changes.

5. The construction according to claim 3, wherein an intermediate layer that is made of a ductile material is arranged between the outer flange at the end of the sheathing and the flange ring.

6. The construction according to claim 1, wherein the structure is a pylon of a cable stayed bridge.

7. The construction according to claim 1, wherein the individual elements are steel wire strands.

8. The construction according to claim 5, wherein the ductile material is made of rubber or plastic.

9. The construction according to claim 1, wherein a saddle pipe is formed within the guide canal, and the guide canal has a wider diameter than the saddle pipe.

10. The construction according to claim 1, wherein the recess pipe has an oval shape.

11. The construction according to claim 9, wherein a recessed saddle bearing is formed at a vertex area of the structure where a recess is located, which engages a cleat that is firmly attached to the saddle pipe.

12. The construction according to claim 9, wherein the saddle pipe has a smaller diameter than the connecting pipe.

* * * * *